US012473847B2

(12) United States Patent
Císar et al.

(10) Patent No.: US 12,473,847 B2
(45) **Date of Patent: *Nov. 18, 2025**

(54) CASTELLATION ASSEMBLY, ROCKER ARM, AND ACTUATOR ASSEMBLY THEREFOR

(71) Applicant: Eaton Intelligent Power Limited, Dublin (IE)

(72) Inventors: Ondrej Císar, Dvur Králové nad Labem (CZ); Zdenek Hübner, Horousánky (CZ)

(73) Assignee: Eaton Intelligent Power Limited, Dublin (IE)

( * ) Notice: Subject to any disclaimer, the term of this patent is extended or adjusted under 35 U.S.C. 154(b) by 0 days.

This patent is subject to a terminal disclaimer.

(21) Appl. No.: 18/789,186

(22) Filed: Jul. 30, 2024

(65) Prior Publication Data

US 2024/0418108 A1 Dec. 19, 2024

Related U.S. Application Data

(63) Continuation of application No. 18/246,998, filed as application No. PCT/EP2021/025421 on Oct. 22, 2021, now Pat. No. 12,071,870.

(60) Provisional application No. 63/104,049, filed on Oct. 22, 2020.

(51) Int. Cl.

| | |
|---|---|
| ***F01L 13/06*** | (2006.01) |
| ***F01L 1/18*** | (2006.01) |
| ***F01L 13/00*** | (2006.01) |
| *F01L 1/26* | (2006.01) |
| *F01L 1/46* | (2006.01) |
| *F01L 13/08* | (2006.01) |

(52) U.S. Cl.

CPC ..... *F01L 13/065* (2013.01); *F01L 1/181* (2013.01); *F01L 13/0005* (2013.01); *F01L 1/26* (2013.01); *F01L 2001/467* (2013.01); *F01L 13/08* (2013.01); *F01L 2305/00* (2020.05)

(58) Field of Classification Search

CPC ... F01L 1/181; F01L 1/26; F01L 1/267; F01L 2001/467; F01L 13/0005; F01L 2013/001; F01L 13/065; F01L 13/08; F01L 2305/00

See application file for complete search history.

(56) References Cited

U.S. PATENT DOCUMENTS

2017/0051638 A1* 2/2017 Cecur ..... F01L 1/267

* cited by examiner

*Primary Examiner* — Loren C Edwards

(74) *Attorney, Agent, or Firm* — Baker Botts L.L.P.

(57) ABSTRACT

A castellation assembly can comprise a first toothed body comprising a first toothed end and a biased end comprising a projecting lever. The projecting lever can be configured to extend out from the biased end and contact an actuation lever throughout a travel of the first toothed body. The second toothed body can comprise a base and a second toothed end configured to mesh between or stack against the first toothed end. A castellation spring can be configured to push the first and second toothed body apart. An actuator assembly can actuate the castellation assembly and comprise an actuating lever assembly configured to reciprocate between a contacting position against the projecting lever and a clearance position spaced from the projecting lever. A rocker arm in a valvetrain can be controlled for variable valve actuation thereby.

20 Claims, 9 Drawing Sheets

CASTELLATION ASSEMBLY, ROCKER ARM, AND ACTUATOR ASSEMBLY THEREFOR

PRIORITY

This application is a continuation under 35 U.S.C. § 120 of U.S. patent application Ser. No. 18/246,998, filed 28 Mar. 2023, which claims the benefit under 35 U.S.C. § 371 of International Patent Application No. PCT/EP2021/025421, filed 22 Oct. 2021, which claims the benefit under 35 U.S.C. § 119(e) of U.S. Provisional Patent Application No. 63/104,049, filed 22 Oct. 2020, all of which are incorporated herein by reference.

TECHNICAL FIELD

This application provides a castellation assembly that can be installed in a rocker arm of a valvetrain and actuated upon by an actuator assembly. The actuator assembly switches the toothed ends of the castellation assembly between meshed and stacked positions.

BACKGROUND

Variable valve actuation is desired for combustion engines. It is desired to turn lift profiles on and off to facilitate functions like early or late valve opening or closing, or synchronized action of the intake and exhaust valves for functions like cylinder deactivation or internal exhaust gas recirculation. Constraints for this include packaging space, reliability, and weight, among others.

SUMMARY OF PARTICULAR EMBODIMENTS

The methods and devices disclosed herein overcome the above disadvantages and improves the art by way of a castellation assembly that can comprise a first toothed body, a second toothed body, and a castellation spring. The first toothed body comprises a biased end comprising a projecting lever. The projecting lever can be configured to extend out from the biased end and contact an actuation lever throughout a travel of the first toothed body. The first toothed body can comprise a first toothed end. The second toothed body can comprise a base and a second toothed end configured to mesh between or stack against the first toothed end. A castellation spring can be configured to push the first and second toothed body apart.

A guide portion can jut from the first toothed body. Then, a guiding groove can be formed in the castellation bore of the valvetrain subcomponent, here, a rocker arm.

A lash pin and a lash nut can connecting the first toothed body and the second toothed body. A washer can also be included to join the parts together. By tightening the lash nut relative to the lash pin, the length of the assembly can be adjusted to calibrate the lash for the cylinder of the valvetrain associated with the valves.

A biasing device can bias the first toothed end to one of meshing with or stacking against the second toothed end. The biasing device comprises a torsion spring pressing against the projecting lever.

An actuator assembly can actuate the castellation assembly and can comprise an actuating lever assembly configured to reciprocate between a contacting position against the projecting lever and a clearance position spaced from the projecting lever.

The actuator assembly can comprise a shaft configured to linearly reciprocate, a first actuator stop, a second actuator stop, an actuator spring biased against one of the first actuator stop and the second actuator stop, and the actuating lever assembly. The actuating lever assembly can be biased by the actuator spring against the other of the first actuator stop and the second actuator stop.

The actuating lever assembly can be configured to slide in contact against the projecting lever when the castellation assembly is acted upon by the actuator assembly. The projecting lever can be flared. It can be characterized as shaped like a hockey stick. Then the actuating lever can follow the arc of motion of the projecting lever as the rocker arm rotates on the rocker shaft.

The actuator assembly can be configured to store actuation force in the actuator spring when the shaft moves and the second toothed end is one of meshed between or compressed against the first toothed end.

The castellation assembly can further comprise a biasing device biasing the first toothed end to one of meshing with or stacking against the second toothed end. The biasing device can be configured, when acted on by the actuator assembly, to store biasing force to return the first toothed body to the one of the meshing or stacking.

A rocker arm in a valvetrain can be controlled for variable valve actuation thereby. A valvetrain can comprise the actuator assembly and the castellation assembly. The valvetrain can comprise a rocker shaft, and a rocker arm configured to rotate on the rocker shaft. The rocker arm can comprise a cam end and a castellation bore for housing the castellation assembly. A cam can be configured in the valvetrain to rotate and transfer a lift profile to the cam end of the rocker arm.

When the actuator assembly is in the contacting position against the projecting lever, and when the cam transfers the lift profile to the cam end thereby rotating the rocker arm, the actuating lever assembly can slide along the projecting lever. The sliding end of the actuating lever assembly can provide positioning force to the projecting lever and the alignment of the teeth as either meshed or stacked. Then, the bias spring cannot overcome the alignment forces if there is any disruption in lift profile transfer from the cam to the cam end. A misalignment cannot give the bias spring opportunity to act on the projecting lever prematurely.

The actuator assembly can be configured to store actuation force in the actuator spring when the shaft moves and when the second toothed end is one of meshed between the first toothed end or compressed against the first toothed end via transfer of the lift profile from the cam.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

DESCRIPTION OF EXAMPLE EMBODIMENTS

Reference will now be made in detail to the examples which are illustrated in the accompanying drawings. Wherever possible, the same reference numbers will be used throughout the drawings to refer to the same or like parts. Directional references such as "up" and "down" are for case of reference to the figures.

Figure 5:
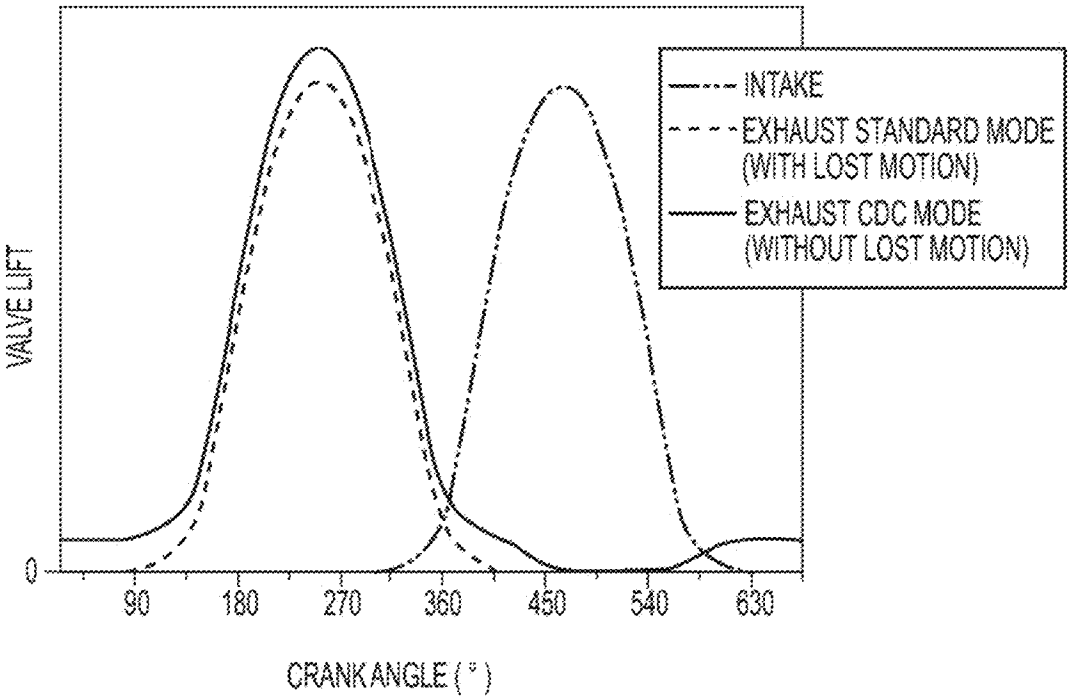
FIG. 5 is an explanatory view comparing an exemplary variable valve lift mode to a standard lift mode.
Figure 6:
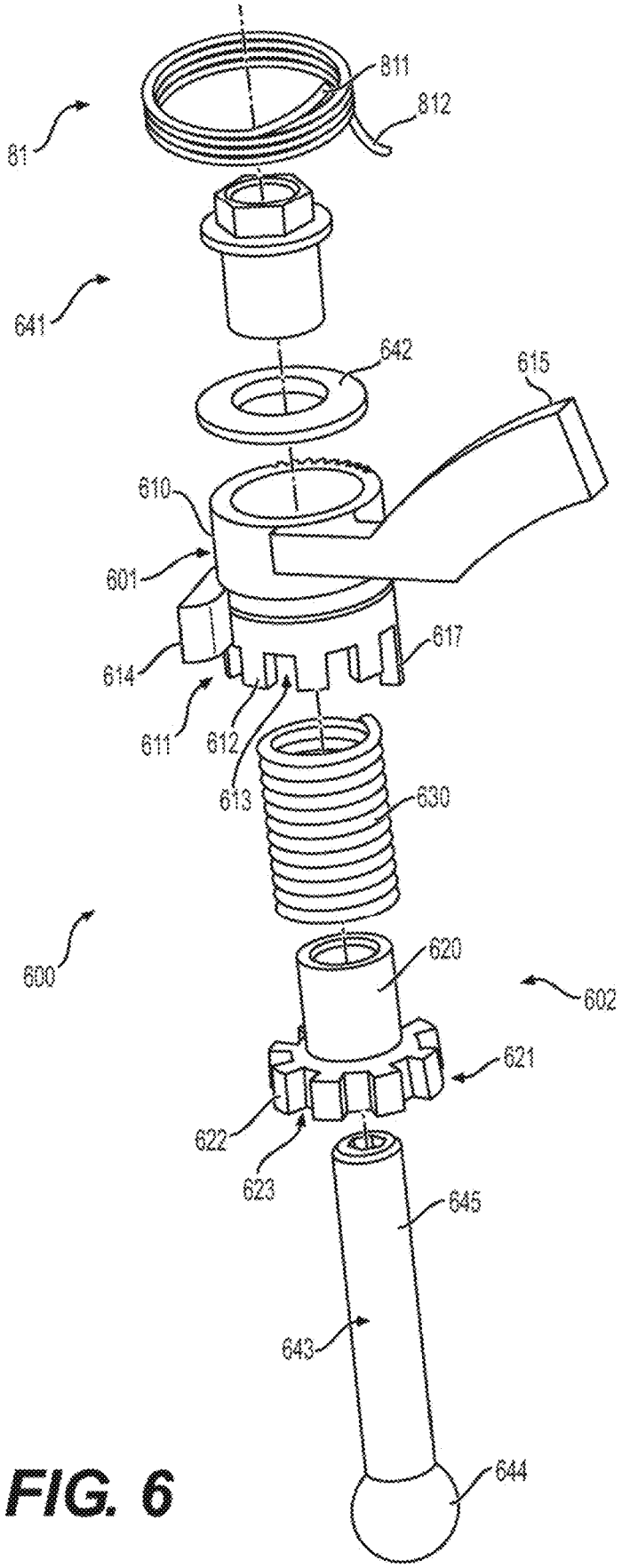
FIG. 6 is an exploded view of a castellation assembly and a bias device usable therewith.

FIG. 5 shows an exemplary view comparing an exemplary variable valve lift mode to a standard lift mode. By actuating the castellation assembly as described in more detail below, a first valve lift mode (standard mode) can be applied to one or more valves of an engine. Two valves 73, 74 are illustrated joined by a bridge 72. An additional variable valve lift mode, such as engine braking, can be applied via pass-through stem 75. A second rocker arm can adjoin rocker arm 100 to actuate the pass-through stem 75. Or, rocker arm 100 can be direct-acting on a single valve stem, among alternatives known in the art. The example shows that the pair of exhaust valves can move together via the valve bridge 72 to open and close. "Lost motion" is supplied via the castellation assembly 600, as by permitting teeth 612, 622 to mesh in gaps 613, 623. By actuating the castellation assembly 600, the teeth 612, 622 can stack against each other to enable a larger lift profile on the exhaust valves, corresponding in the working example to be a cylinder decompression mode. Many alternatives exist. For example, the meshing of the teeth 612, 622 in gaps 613, 623 can yield cylinder deactivation, whereby valve actuation is "lost." A reverse lift profile can be implemented so that the standard mode yields an early valve opening and a late valve closing when the teeth 612, 622 are stacked, then the meshing of teeth 612, 622 in gaps 613, 623 can yield a late valve opening and an early valve closing. Such can be implemented on intake or exhaust valves to regulate the combustion process.

The working example is applied to an OHC (overhead cam) or OHV (overhead valve) valvetrain 1, also referred to as a type III engine. A rocker arm assembly 100 compatible with the working example is illustrated as a type III or center pivot type rocker arm. But, the castellation assembly 600 can be used in other locations in the valvetrain where it can align with a compatible actuator assembly 40. For example, castellation assembly 600 can be placed at the top of a pushrod or push tube, in a valve actuation tower, at a cam follower, in a divided roller rocker arm body, in place of another lost motion capsule of a roller rocker arm (RRA), in combination with a hydraulic capsule such as a lash adjuster or spool, among other possible locations. The castellation assembly 600 can be integrated to form a drop-in capsule, or its installation location, such as castellation bore 20, can be machined or molded to house the components. Stop surface, guide grooves, and the like can be formed in the castellation bore 20. Oil ports are shown in the Figures and can be used for lubrication or to aid in pressurizing the castellation assembly 600 among other purposes (such as hydraulic lash or spool action when combined as taught above).

A step towards electrification of commercial vehicles can be through hybridization of the powertrain. An integrated de-compressor system helps the engine to spin easier during starts or during coasting on electric power.

During engine starts a starter overpowers forces from compression inside a combustion chamber. The initiation of turning the crankshaft has significant electric consumption from a battery. With the premise that an engine is going to be equipped for switching between conventional powertrain and electric powertrain or start/stop system there will be an effort to decrease electric consumption from batteries with the intention to keep the vehicle operation range on electric energy as high as possible. A cylinder de-compressor can help the starter smoothly turn the engine with lower required torque in a cylinder de-compression ("CDC") mode.

To facilitate these teachings, it is possible to enlarge a radius of an exhaust cam lobe (cam 10). During CDC mode, an enlarged cam base circle 12 keeps the exhaust valve(s) open. During a standard mode, a portion of the valve lift is reduced by a lost motion mechanism (castellation assembly 600) and the valves 73, 74 have a standard lift and can be fully closed when the cam end 101 is in contact with base circle 12. To implement this strategy, the valvetrain 1 can comprise a lost motion-providing castellation assembly 600, a linear actuator assembly 40, and a special design of the cam lobe 10. For CDC mode, it is possible to have the valves 73, 74 held open to avoid compression and expansion of gasses in a corresponding cylinder. During an intake phase it is possible to keep an exhaust valve closed. Thanks to the special cam lobe design of cam 10, the exhaust valves keep closed during the intake phase in drive mode and CDC mode. Another advantage are low forces needed for latching because the system is relieved of the forces from the exhaust valve springs during the intake phase.

Figure 2A:
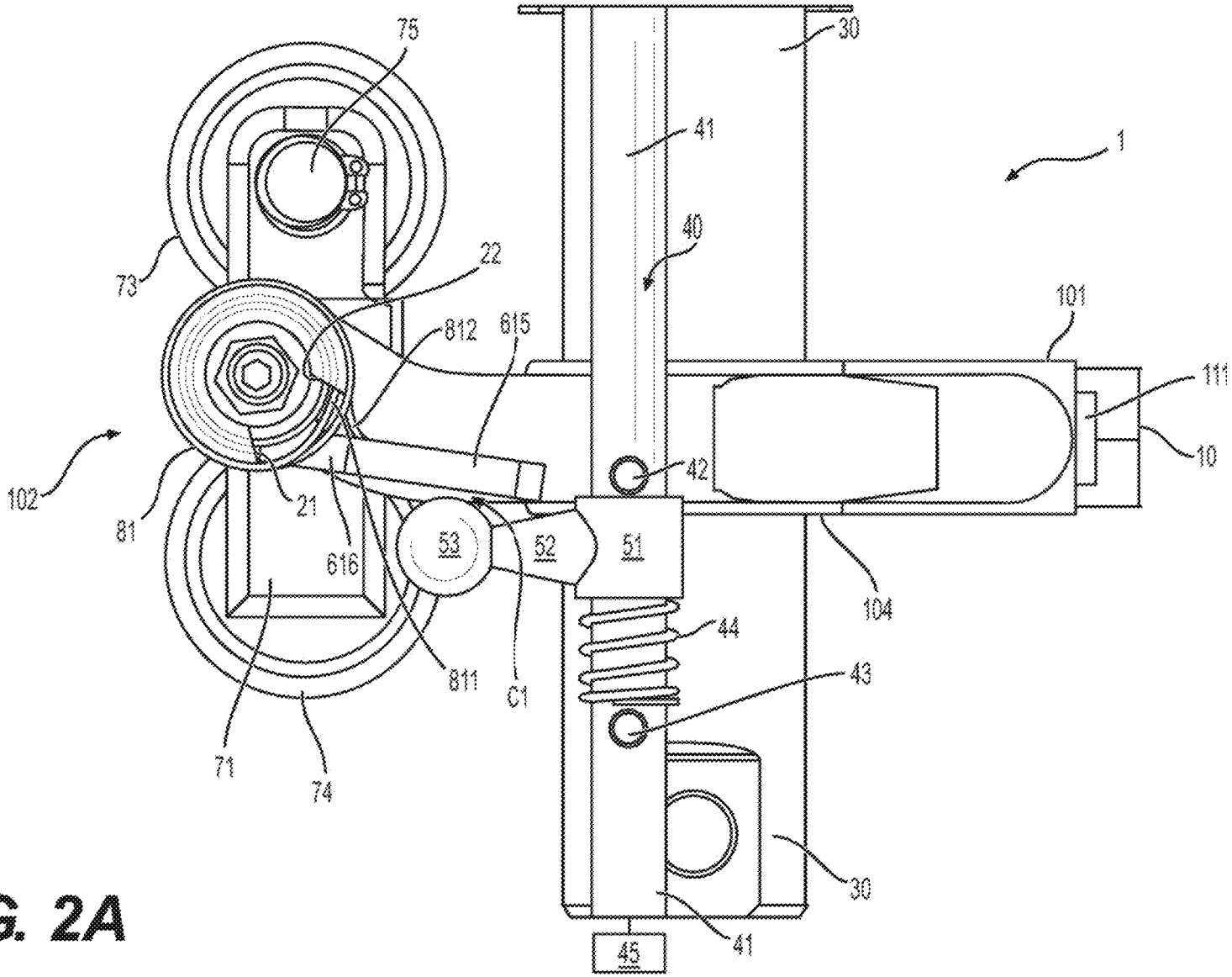
FIGS. 2A & 2B are views of a first configuration, or drive mode.
Figure 2B:
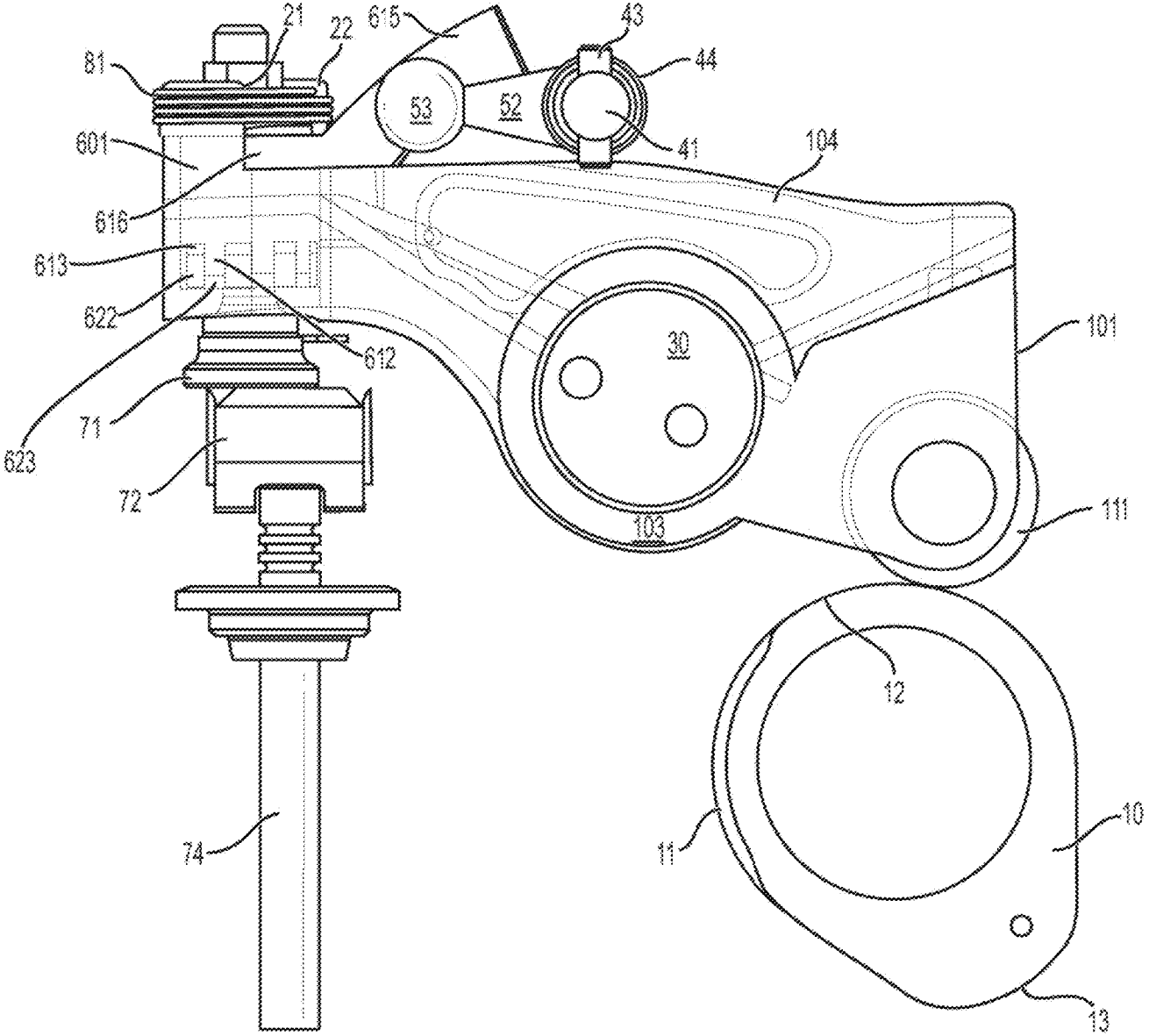
Figure 3A:
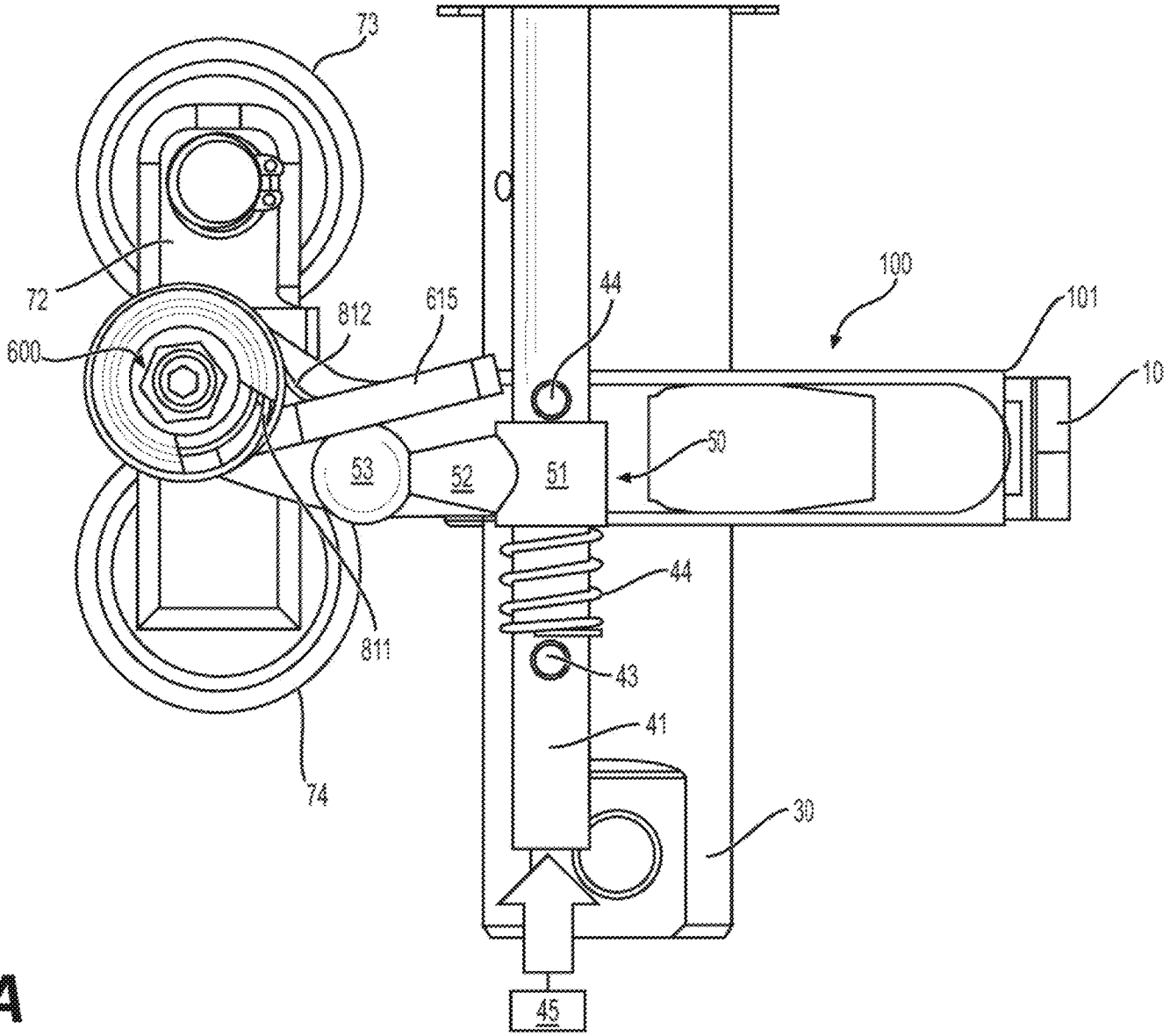
FIGS. 3A-3C are views of a second configuration, or auxiliary mode.
Figure 3B:
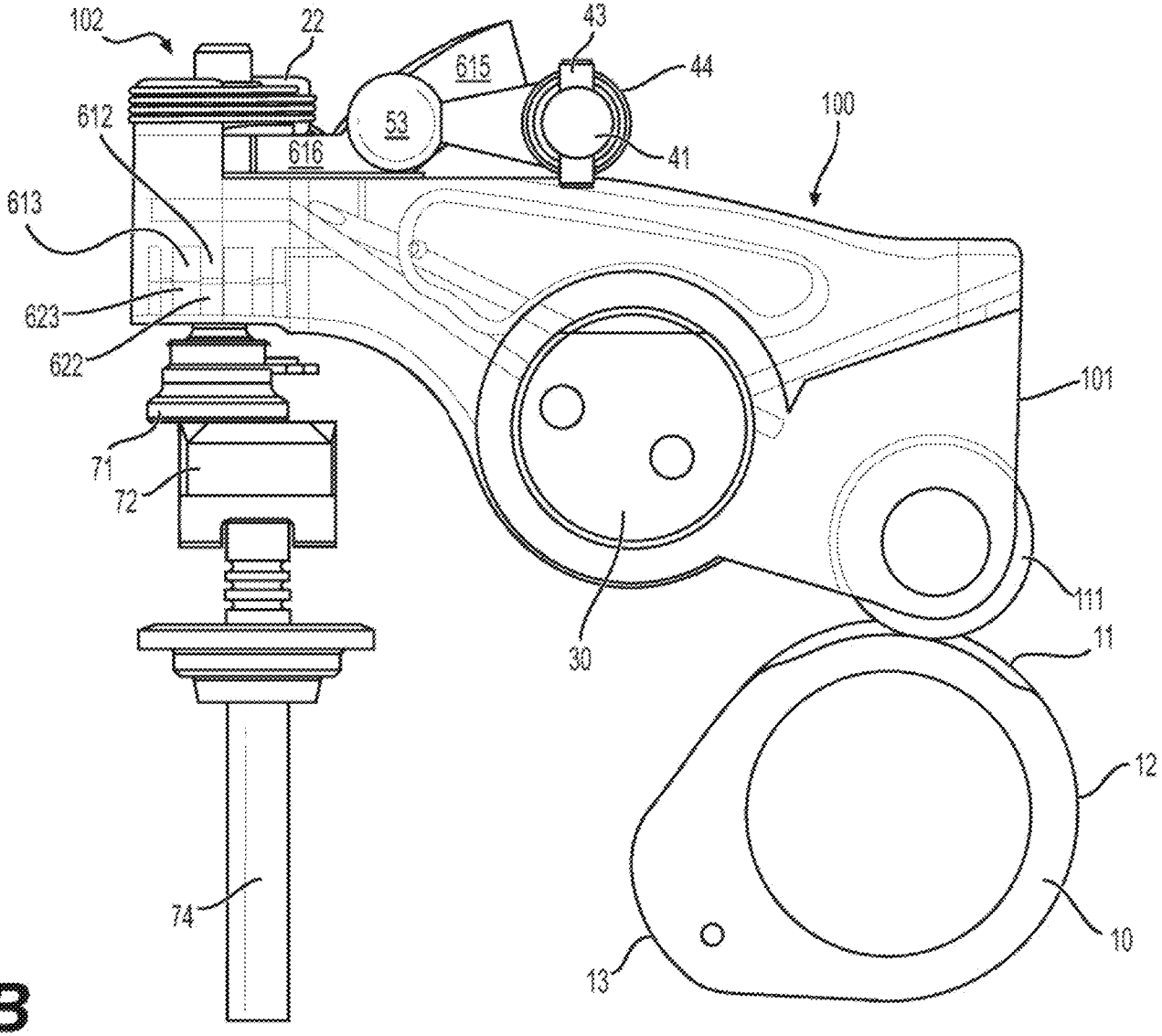
Figure 3C:
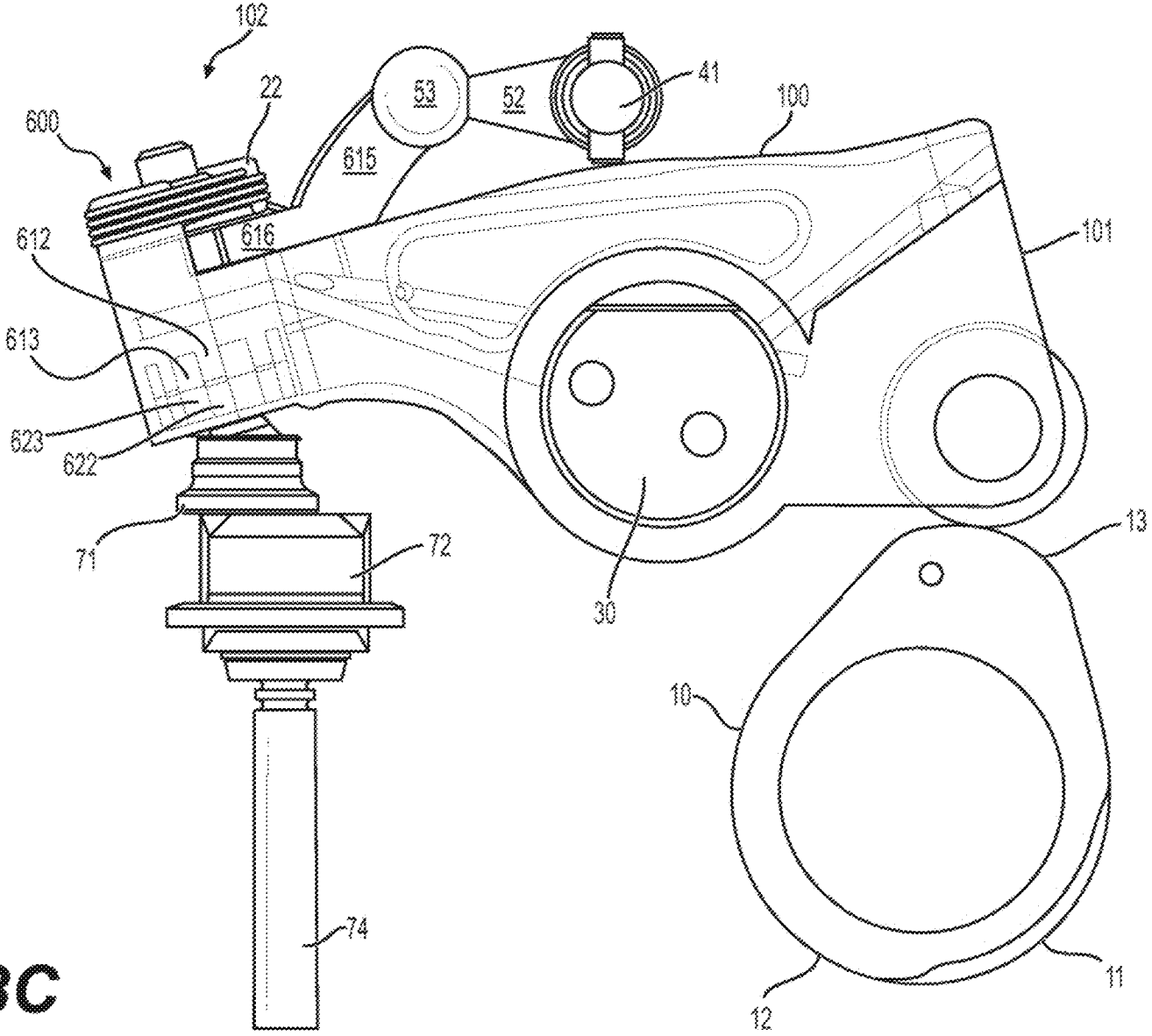

In drive mode (FIGS. 2A & 2B), the cam lobe 13 opens the exhaust valve in a standard valve lift profile. A projecting lever 615 and castellation assembly 600 are not in contact with the rocker arm 100 to transfer forces therethrough. A clearance C1 is between the sliding end 53 of the actuating lever assembly 50 and the projecting lever 615. The biasing device 81 can be used to maintain the alignment of the first toothed body 601 relative to the second toothed body 602 to that the teeth 612, 622 mesh in corresponding gaps 613, 623 (or, stack, if the standard mode is selected to have a larger lift profile than the auxiliary mode). Rocker arm 100 position is kept by the biasing device 81 for transfer of the lift profile to the valves 73, 74. Lost motion on base circle 12 is possible.

When converting from drive mode to CDC mode, an actuator assembly 40 is used. The actuator assembly 40 can be controlled to either push or pull on shaft 41 and the default configuration can be push or pull depending on the variable valve actuation mode implemented, or mirror image implementations can be had, as needed. But, the working example has the drive mode with clearance C1 and a transition to the auxiliary mode achieved by pushing shaft 41 in a direction into the page of FIGS. 2A & 2B. Actuator 45 (electric, pneumatic, or hydraulic device, such as a solenoid, swing arm, lever, linear motor, movable piston, other linear actuator, among others) moves the shaft 41 and increases the preload in compliance spring (actuator spring 44). With the travel of the mounting end 51 of actuating lever assembly 50 limited by an actuator stop 42 and with the travel of the spring limited by an actuator stop 43, the shaft 41 can only slide so much before the actuator spring 44 causes the actuating lever assembly 50 to slide and close the clearance C1. The forces can accumulate to cause actuating lever assembly 50 to shift towards the projecting lever 615. After an exhaust compliance spring (biasing device 81) moves with the projecting lever 615 and with the first toothed body 601, the alignment of the teeth 612, 622 is changed so that lost motion is not possible and the teeth 612, 622 stack against each other. After the intake phase, the exhaust valves 73, 74 are kept open on base circle 12 by the additional lift provided by the stacked teeth 612, 622.

A benefit of the spring-loaded actuating lever assembly 50 is that variance in the valvetrain 1 can be readily absorbed by the design. Some play in the tolerances can be accommodated via clearance C1.

Another benefit is that the timing of the motion of the shaft 41 is more flexible. The actuator 45 can be controlled to move the shaft 41 before the castellation assembly 600 is perfectly aligned to switch from meshed to stacked. The actuator spring 44 can store the force needed to move actuating lever assembly 50 and that stored force can be released on projecting lever 615 when the rocker arm 100 returns to a position where castellation spring 630 can push first body 601 and second body 602 apart.

For example, while the castellation assembly 600 and rocker arm 100 are configured for CDC mode, the shaft 41 can be held in position to keep the projecting lever 615 in contact with the sliding end 53 and the teeth 612, 622 of the castellation assembly 600 contact.

Figure 1:
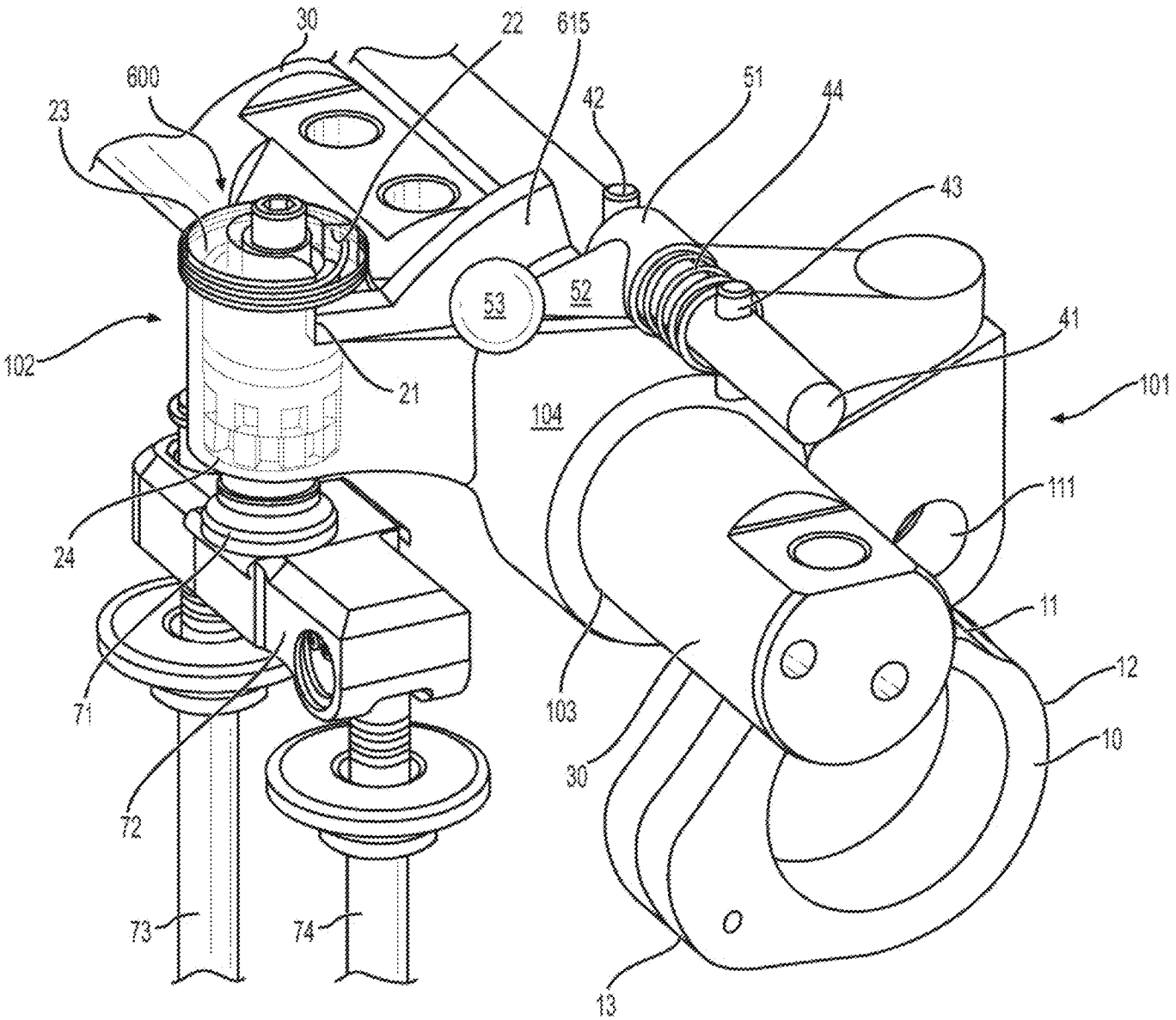
FIG. 1 is a view of a valvetrain assembly, comprising a rocker arm assembly, an actuator assembly, and a castellation assembly.
Figure 4:
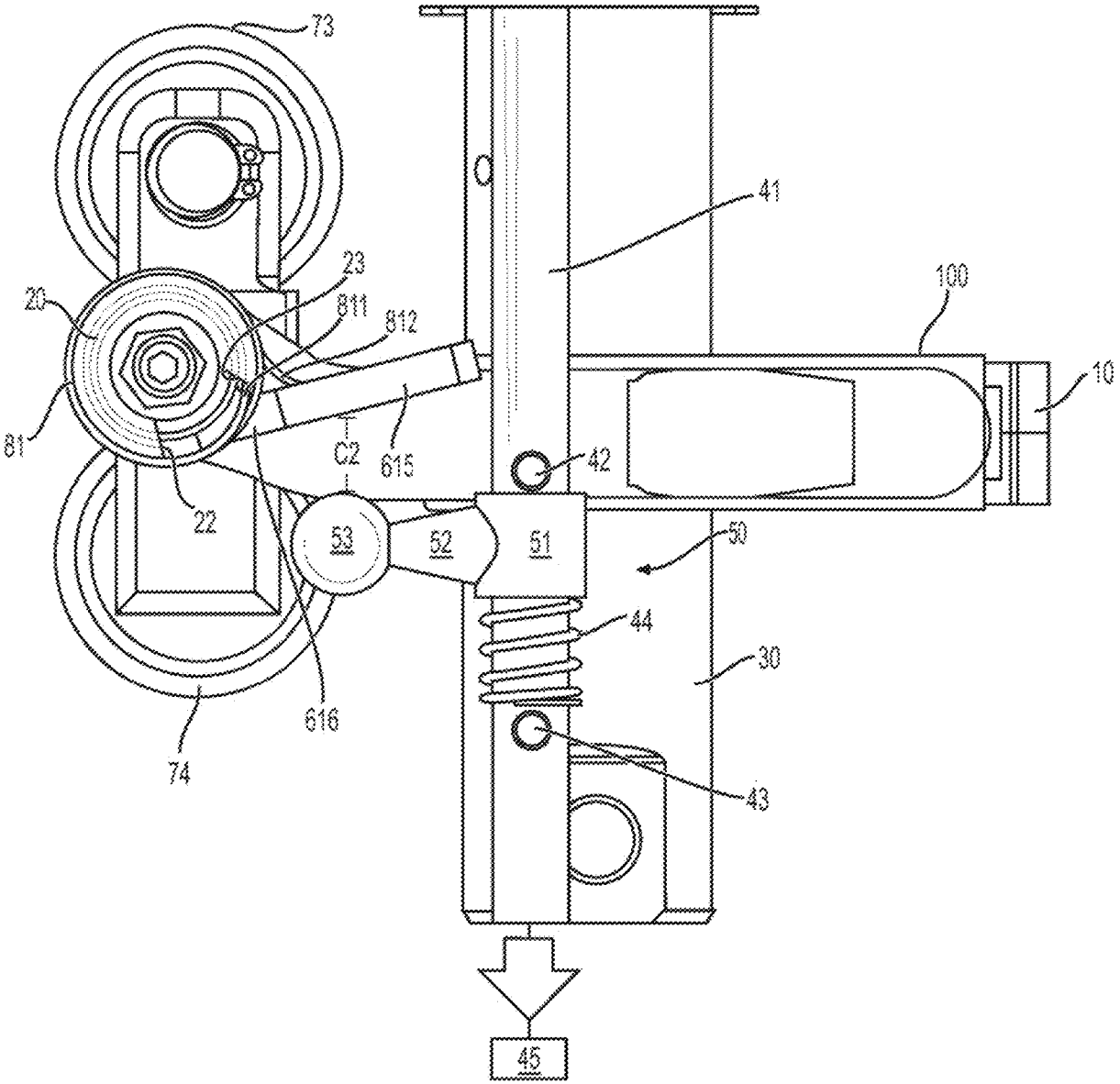
FIG. 4 is a view of a third configuration, or transition mode.

But, during a transition from CDC mode to drive mode (FIG. 4) a large clearance C2 can be had. The actuation source 45 can move the shaft 41 linearly to slide the actuating lever assembly 50. With the shaft 41 moved out of the page relative to FIG. 1, castellation assembly engagement is kept by friction until the end of the exhaust lift. The cam 10 is actively transferring force to the rocker arm 100 and the pushing of the cam to rotate the rocker arm 100 on the rocker shaft 30 provides more force that the biasing device 81 can provide. So, the biasing device cannot rotate the first toothed body 601 to any other position than the CDC mode position that it is in. But, after the rocker arm 100 roller follows the cam lobe 13 back to base circle 12, the first toothed body 601 is free to move under the forces of the biasing device 81. Now, the torsional spring can turn the first toothed body 601 and lost motion can follow on the next valve lift cycle after base circle 12.

It is possible to provide an addition transition zone 11 in the cam. The transition zone 11 can cause the rocker arm 100 to rotate on the rocker shaft 30 to a position that releases the valve end 102 from cylinder forces, making it easier for castellation spring 630 to push the first and second toothed bodies 601, 602 apart. Rotating action from the biasing device 81 to the first toothed body 601 is more easily applied in this configuration. As an option, a lash or other gap can be had between the first and second toothed bodies 601, 602 to aid in case of force transfer from the biasing device 81.

Biasing device 81 can bias the first toothed end 611 to one of meshing with or stacking against the second toothed end 621. The biasing device 81 can comprise a torsion spring pressing against the projecting lever 615 or the extension piece 616. Extension piece 616 can be an optional piece of material used to extend the projecting lever 615 out from the first toothed body 601. Extension piece 616 cam position projecting lever 615 outside of the confines of the castellation bore 20 for easy access to the actuating lever assembly 50.

Other biasing devices can be contemplated, such as one of biasing devices 236, 336 disclosed in US 2020/0325803, owned by the instant Applicant and assignee. Such an alternative biasing device can replace guide portion 614, relying instead on guide tooth 617 for guidance of the first toothed body 601. While biasing device 81 is shown mounted on an exterior of valve end 102, it is not limited to this, and can be integrated within the castellation bore 20.

The castellation assembly 600 that can comprise a first toothed body 601, a second toothed body 602, and a castellation spring 630. The first toothed body 601 comprises a biased end 610 comprising a projecting lever 615. The projecting lever 615 can be configured to extend out from the biased end 610 and contact the actuation lever assembly 50 throughout a travel of the first toothed body 601. The first toothed body 601 can comprise a first toothed end 611. The second toothed body 602 can comprise a base 620 and a second toothed end 621 configured to mesh between or stack against the first toothed end 611. A castellation spring 630 can be configured to push the first and second toothed bodies 601, 602 apart.

A guide portion 614 can jut from the first toothed body 601. Then, a guiding groove can be formed in the castellation bore 20 of the valvetrain subcomponent, here, a rocker arm 100. The guide portion 614 can prevent the first toothed body 601 from collapsing into the castellation bore 20. The second toothed body 602 can move up to mesh or stack against the first toothed body 601. Then, gravity can help the second toothed body 602 return to the home position when on base circle 12 or in the optional transition zone 11.

An additional guide tooth 617 can extend down past the other teeth 612 of the first toothed end 611. A guide slot can be formed in one or both of the second toothed body 602 and the castellation bore 20. The guide slot and guide tooth 617 can cooperate to prevent over-rotation of the first toothed body 601. The guide tooth 617 can be used with or without the guide slot to set a vertical height of the first toothed body 601 in the castellation bore 20.

A lash pin 643 and a lash nut 641 can connect the first and second toothed body 601, 602. A washer 642 can also be included to join the parts together. The washer 642 can serve to aid in locating the castellation assembly 600 in the castellation bore 20. By tightening the lash nut 641 relative to the lash pin 643, the length of the castellation assembly 600 can be adjusted to calibrate the lash for the cylinder of the valvetrain 1 associated with the valves 73, 74. Lash pin 643 can comprise a valve end portion 644, illustrated as a spigot. An elephant foot (e-foot) 71 can seat against valve end portion 644. A spring guide portion 645 can locate the castellation spring 630 and assist with setting the lash. Lash nut 641 can comprise a stabilizing body, locating rim, and nut feature. As an option a screw or stake can be dropped into the lash nut 641 and joined to the lash pin 643.

An actuator assembly 40 can actuate the castellation assembly 600 and can comprise an actuating lever assembly 50 configured to reciprocate between a contacting position against the projecting lever 615 and a clearance position spaced from the projecting lever 615.

The actuator assembly 40 can comprise a shaft 41 configured to linearly reciprocate, a first actuator stop 42, a second actuator stop 43, an actuator spring 44 biased against one of the first actuator stop 42 and the second actuator stop 43, and the actuating lever assembly 50. The actuating lever assembly 50 can be biased by the actuator spring 44 against the other of the first actuator stop 42 and the second actuator stop 43.

The actuating lever assembly 50 can be configured to slide in contact against the projecting lever 615 when the castellation assembly 600 is acted upon by the actuator assembly 40. The actuating lever assembly 50 can comprise mounting end 51 configured to slide on shaft 41. If the shaft 41 is pressed too far towards the projecting lever 615, as because of some variance, the actuating lever assembly 50 can compress the spring 44 and travel away from actuator stop 42. As another example, the travel limits 21, 22 of the castellation bore 20 can restrict how much the projecting lever 615 (or optional extension piece 616) can swing. When travel limit 22 is reached, then the actuating lever assembly 50 can compress the actuator spring 44 instead of flexing the projecting lever 615.

The actuator assembly 40 can be configured to store actuation force in the actuator spring 44 when the shaft 41 moves and the second toothed end 621 is one of meshed between or compressed against the first toothed end 611.

The castellation assembly 600 can further comprise a biasing device 81 biasing the first toothed end 611 to one of meshing with or stacking against the second toothed end 621. The biasing device 81 can be configured, when acted on by the actuator assembly 41, to store biasing force to return the first toothed body to the one of the meshing or stacking.

A rocker arm 100 in a valvetrain 1 can be controlled for variable valve actuation ("VVA") by the actuator assembly 40. A valvetrain 1 can comprise the actuator assembly 40 and the castellation assembly 600. The valvetrain 1 can comprise a rocker shaft 30, and a rocker arm 100 configured to rotate a rocker bore 103 of the rocker body 104 on the rocker shaft 30. The rocker arm 100 can comprise a cam end 101. The cam end 101 can comprise a roller 111 or tappet surface.

Rocker arm can comprise a castellation bore 20 for housing the castellation assembly 600. Castellation bore 20 can comprise an actuation end 23 comprising travel limits 21, 22 and a valve contact end 24. An additional washer or snap ring or bushing can be placed in valve contact end 24 to prevent the castellation assembly 600 from falling out of the castellation bore 20. A cam 10 can be configured in the valvetrain 1 to rotate and transfer a lift profile to the cam end 101 of the rocker arm 100.

When the actuator assembly 40 is in the contacting position against the projecting lever 615, and when the cam 10 transfers the lift profile to the cam end 101 thereby rotating the rocker arm 100, the actuating lever assembly 50 can slide along the projecting lever 615. The sliding end 53 of the actuating lever assembly 50 can comprise a ball joint, for example, to aid with sliding and actuating. An optional extension section 52 can set a distance between the sliding end 53 and the mounting end 51.

With the rocker arm 100 rotating on the rocker shaft 30, the motion of the valve end 102 is not perfectly linear in the working example, whereas it can be linear in, for example, a lash adjuster, a tower, or pushrod configuration (resulting in an alternative shape for projecting lever 615 to track the linear motion). So, the projecting lever 615 can be flared or arced or shaped like the blade of a hockey stick, to follow the arc of motion that the valve end 102 travels. The projecting lever 615 can be flared. It can be characterized as shaped like a hockey stick.

Then, the sliding end 53 of the actuating lever assembly 50 provides positioning force to the projecting lever 615 to maintain the alignment of the teeth 612, 622 as either meshed or stacked. Then, the bias spring 81 cannot overcome the alignment forces if there is any disruption in lift profile transfer from the cam 10 to the cam end 101. A misalignment cannot occur from vibration or other things, like the change in rocker arm rotation provided by transition zone 11. So, the bias spring 81 is not given the opportunity to act on the projecting lever 615 to counter the actuator assembly 40 until the shaft 41 and actuating lever assembly 50 are moved to provide clearance C1 or C2. The location of the projecting lever 615 can be tuned for the application by including the extension section 616 that extends the projecting lever 615 out of the castellation bore 20. The extension section 616 also serve as a stopping surface for abutting the travel limits 21, 22 that can be machined in the valve end 102. One of the travel limits 21, 22, in this example travel limit 22, can serve as a biasing surface for first end 811 of biasing device 81. The second end 812 of biasing device 81 can abut the extension section 616, when included, or can abut the projecting lever 615. Preferably the abutment of second end 812 is on a side upon which the sliding end 53 does not travel. The first and second ends 811, 812 of the biasing device 81 can be bent or curled to increase the footing or locating for providing bias.

The actuator assembly 40 can be configured to store actuation force in the actuator spring 44 when the shaft 41 moves and when the second toothed end 621 is one of meshed between the first toothed end 611 or compressed against the first toothed end 611 via transfer of the lift profile from the cam 10.

Other implementations will be apparent to those skilled in the art from consideration of the specification and practice of the examples disclosed herein.

What is claimed is:

1. A rocker arm assembly, comprising:
- a rocker arm having a castellation bore;
- a castellation assembly at least partially received in the castellation bore, the castellation assembly comprising:
  - a first toothed body having a projecting lever and a first toothed end;
  - a second toothed body having a second toothed end, the second toothed end configured to mesh with or stack against the first toothed end; and
  - a castellation spring configured to bias the first toothed body and the second toothed body apart; and
- an actuator assembly configured to act on the castellation assembly and comprising an actuation lever assembly movable between (a) a contact position at which the actuation lever assembly contacts a portion of the projecting lever and (b) a clearance position at which a clearance is formed between the actuation lever assembly and the portion of the projecting lever.

2. The rocker arm assembly of claim 1, wherein the actuator assembly is configured to store an actuation force when the actuator assembly is actuated and the second toothed end is one of meshing with or stacking against the first toothed end.

3. The rocker arm assembly of claim 1, wherein the actuator assembly is spring-loaded.

4. The rocker arm assembly of claim 1, wherein the actuator assembly further comprises:
- a shaft;
- a first actuator stop; and
- a second actuator stop,
- wherein the actuation lever assembly is configured to slide on the shaft between the first actuator stop and the second actuator stop.

5. The rocker arm assembly of claim 4, wherein the actuation lever assembly is biased against the first actuator stop or the second actuator stop.

6. The rocker arm assembly of claim 4, wherein the actuation lever assembly is biased by an actuation spring.

7. The rocker arm assembly of claim 4, wherein the actuation lever assembly comprises a mounting end slidably mounted to the shaft and a sliding end configured to contact against the projecting lever when the actuation lever assembly is in the contact position.

8. The rocker arm assembly of claim 7, wherein the sliding end comprises a ball joint.

9. The rocker arm assembly of claim 7, wherein the actuation lever assembly further comprises an extension section extending between the mounting end and the sliding end.

10. The rocker arm assembly of claim 4, wherein the shaft is configured to linearly reciprocate.

11. The rocker arm assembly of claim 4, wherein the shaft is actuated via an electric actuator, a pneumatic actuator, or a hydraulic actuator.

12. The rocker arm assembly of claim 1, wherein the projecting lever extends out of the castellation bore.

13. The rocker arm assembly of claim 1, wherein the castellation bore comprises one or more travel limits configured to limit a travel of the projecting lever.

14. The rocker arm assembly of claim 1, wherein the castellation assembly further comprises a biasing device biasing the first toothed end to one of meshing with or stacking against the second toothed end.

15. The rocker arm assembly of claim 14, wherein the biasing device is configured, when the castellation assembly is acted by the actuator assembly, to store a biasing force to return the first toothed end to one of meshing with or stacking against the second toothed end.

16. The rocker arm assembly of claim 14, wherein the biasing device comprises a torsion spring pressing against the projecting lever.

17. The rocker arm assembly of claim 1, wherein the castellation assembly further comprises a guide portion jutting from the first toothed body.

18. The rocker arm assembly of claim 1, wherein the castellation assembly further comprises a lash pin and a lash nut connecting the first toothed body and the second toothed body.

19. A valvetrain, comprising:

a first valve and a second valve;

a valve bridge coupled to the first valve and the second valve; and a rocker arm assembly configured to selectively actuate the valve bridge, the rocker arm assembly comprising:

a rocker arm having a castellation bore;

a castellation assembly at least partially received in the castellation bore, the castellation assembly comprising:

a first toothed body having a projecting lever and a first toothed end;

a second toothed body having a second toothed end, the second toothed end configured to mesh with or stack against the first toothed end; and a castellation spring configured to bias the first toothed body and the second toothed body apart; and an actuator assembly configured to act on the castellation assembly and comprising an actuation lever assembly movable between (a) a contact position at which the actuation lever assembly contacts a portion of the projecting lever and (b) a clearance position at which a clearance is formed between the actuation lever assembly and the portion of the projecting lever.

20. A valvetrain, comprising:

a rocker shaft;

a rocker arm assembly configured to rotate on the rocker shaft; and a cam configured to rotate and transfer a lift profile to the rocker arm assembly, wherein the rocker arm assembly comprises:

a rocker arm having a castellation bore;

a castellation assembly at least partially received in the castellation bore, the castellation assembly comprising:

a first toothed body having a projecting lever and a first toothed end;

a second toothed body having a second toothed end, the second toothed end configured to mesh with or stack against the first toothed end; and a castellation spring configured to bias the first toothed body and the second toothed body apart; and an actuator assembly configured to act on the castellation assembly and comprising an actuation lever assembly movable between (a) a contact position at which the actuation lever assembly contacts a portion of the projecting lever and (b) a clearance position at which a clearance is formed between the actuation lever assembly and the portion of the projecting lever.

* * * * *